US009214325B2

(12) United States Patent
Rafferty et al.

(10) Patent No.: US 9,214,325 B2
(45) Date of Patent: Dec. 15, 2015

(54) ION TRAP WITH RADIAL OPENING IN RING ELECTRODE

(71) Applicant: 1ST DETECT CORPORATION, Austin, TX (US)

(72) Inventors: David Rafferty, Webster, TX (US); Michael Spencer, Manvel, TX (US)

(73) Assignee: 1ST DETECT CORPORATION, Austin, TX (US)

( * ) Notice: Subject to any disclaimer, the term of this patent is extended or adjusted under 35 U.S.C. 154(b) by 0 days.

(21) Appl. No.: 14/213,447

(22) Filed: Mar. 14, 2014

(65) Prior Publication Data

US 2014/0264006 A1 Sep. 18, 2014

Related U.S. Application Data

(60) Provisional application No. 61/798,734, filed on Mar. 15, 2013.

(51) Int. Cl.
*H01J 49/00* (2006.01)
*H01J 49/06* (2006.01)
(Continued)

(52) U.S. Cl.
CPC ..... *H01J 49/06* (2013.01); *H01J 49/0013* (2013.01); *H01J 49/0031* (2013.01); *H01J 49/0481* (2013.01); *H01J 49/424* (2013.01)

(58) Field of Classification Search
CPC ..... H01J 49/061; H01J 49/062; H01J 49/063; H01J 49/065; H01J 49/067; H01J 49/10; H01J 49/0054; H01J 49/005; H01J 49/147; H01J 49/424; H01J 49/4235; H01J 27/205; H01J 27/22; H01J 27/24; H01J 27/26
USPC ..... 250/281, 282, 283, 284, 288, 423 R
See application file for complete search history.

(56) References Cited

U.S. PATENT DOCUMENTS 6,075,243 A 6/2000 Nabeshima et al.
7,872,228 B1 * 1/2011 Kim et al. ..... 250/292
(Continued)

OTHER PUBLICATIONS

Invitation to Pay Additional Fees and, where Applicable, Protest Fee under PCT Article 17(3)(a) and Rule 40.1 and 40.2(e) with Partial International Search Results in corresponding International Application No. PCT/US2014/029175, dated Sep. 30, 2014, 6 pages.
(Continued)

*Primary Examiner* — Nicole Ippolito
*Assistant Examiner* — Jason McCormack
(74) *Attorney, Agent, or Firm* — Finnegan, Henderson, Farabow, Garrett & Dunner LLP

(57) ABSTRACT

Apparatuses and methods for performing mass analysis are disclosed. One such apparatus may include an ion trap device. The ion trap device may comprise a first end cap having a first aperture and a second end cap having a second aperture, wherein the first aperture and the second aperture may define an ejection axis. The ion trap device may also comprise a ring electrode substantially coaxially aligned between the first and second end caps. The ring electrode may include an opening extending along a radial direction of the ring electrode, wherein the radial direction is substantially perpendicular to the ejection axis. One such method may include ionizing a sample in an ion trap through an opening separating at least part of first and second ring sections of the ion trap and detecting ions ejected though an aperture on an end cap of the ion trap.

27 Claims, 8 Drawing Sheets

(51) Int. Cl.
*H01J 49/04* (2006.01)
*H01J 49/42* (2006.01)

(56) References Cited

U.S. PATENT DOCUMENTS

| | | | | |
|---|---|---|---|---|
| 2002/0008198 | A1* | 1/2002 | Kasten et al. | 250/292 |
| 2003/0155502 | A1* | 8/2003 | Grosshans et al. | 250/282 |
| 2003/0213908 | A1 | 11/2003 | Umemura | |
| 2004/0173740 | A1 | 9/2004 | McLuckey et al. | |
| 2005/0040327 | A1* | 2/2005 | Lee et al. | 250/288 |
| 2006/0163468 | A1* | 7/2006 | Wells et al. | 250/281 |
| 2008/0203293 | A1* | 8/2008 | Makarov | 250/283 |
| 2009/0242753 | A1* | 10/2009 | Dogourd et al. | 250/283 |
| 2010/0163724 | A1* | 7/2010 | Verbeck, IV | 250/283 |
| 2010/0320377 | A1* | 12/2010 | Cotter et al. | 250/283 |
| 2011/0057097 | A1* | 3/2011 | Bateman et al. | 250/283 |
| 2011/0233397 | A1* | 9/2011 | Barofsky et al. | 250/294 |
| 2012/0298853 | A1* | 11/2012 | Kurulugama et al. | 250/282 |

OTHER PUBLICATIONS

PCT International Search Report and Written Opinion in corresponding International Application No. PCT/US2014/029175, dated Nov. 14, 2014, 16 pages.

* cited by examiner

ION TRAP WITH RADIAL OPENING IN RING ELECTRODE

RELATED APPLICATION

This application claims the benefits of priority to U.S. Provisional Application No. 61/798,734, filed on Mar. 15, 2013, the entire content of which is incorporated herein by reference.

FIELD OF THE DISCLOSURE

The present disclosure relates to apparatuses, systems, and methods for performing mass spectrometric analysis using ion traps. More particularly, the present disclosure relates to apparatuses, systems, and methods for performing mass spectrometric analysis using cylindrical ion traps having a radial opening or openings in the ring electrode to improve capture efficiency and/or ionization efficiency.

BACKGROUND OF THE DISCLOSURE

An ion trap can be used to perform mass spectrometric chemical analysis, in which gaseous ions are filtered according to their mass-to-charge (m/z) ratio. The ion trap can dynamically trap ions from a measurement sample using dynamic electric fields generated by one or more driving signals. The ions can be selectively ejected according to their m/z ratio by changing the characteristics of the electric field. Relative abundance of different ionic species can be measured by scanning the characteristics of the electric field and detecting the ejected ions.

A typical mass spectrometer comprises an ionization source to generate ions from a measurement sample, an ion trap, which may be configured to receive ions and to separate ions in space and/or time, an ion detector to collect filtered/separated ions and measure their abundance, a vacuum system, and power source. Traditionally, to effect trapping of ions, buffer gas (or referred to as cooling gas or damping gas, usually helium) may be added to slow the ions down so that the ion trap can capture them and keep them in the trap. The buffer gas may also be inherently supplied with the sample, for example ambient air. Without the buffer gas, the ions may not be cooled sufficiently to be trapped by the electric field contained within the trap.

Recently, there has been a growing interest in miniaturized mass spectrometers. Miniature (or even portable) analyzers are especially useful in applications such as the detection of chemical warfare agents in combat, detection of pollutants in the field, detection of explosives at airport security checkpoints, etc. The portability of such miniature analyzers may be limited if the effect of cooling ions using a buffer gas is used to trap ions. For example, if an external gas tank has to be included, the overall system may be too large, heavy, or complex for field use. As well, the use of a buffer gas to cool ions may increase the gas load on the system such that pumping requirements are increased beyond what would be practical for a portable instrument. On the other hand, without sufficient buffer gas pressure, the ion capture efficiency may be too low. However, if the buffer gas pressure increases, resolution may suffer, especially when using buffer gasses of higher molecular weight.

Alternate architectures, such as quadrupole filter and time-of-flight mass spectrometers may exist that are more adapted to external ionization, however, these architectures do not lend themselves to miniaturization as well as ion traps. However, ions traps may not be suited to external ionization techniques because the distance over which ions are required to be cooled and trapped is relatively small compared to these architectures.

In addition, it is generally difficult for existing systems (e.g., cylindrical traps) to capture external ions due to potential energy and non-zero kinetic energy at the point of entry.

Therefore, it is desirable to develop ion trap systems and corresponding analyzing methods for performing mass spectrometric analysis with improved capture efficiency yet using a minimum amount of buffer gas pressure to cool the ions sufficiently.

SUMMARY OF THE EMBODIMENTS

Some disclosed embodiments may involve systems or apparatuses for performing mass analysis. One such system or apparatus may comprise an ion trap. The ion trap may comprise a first end cap having a first aperture and a second end cap having a second aperture, wherein the first aperture and the second aperture may define an ejection axis. The ion trap device may also comprise a ring electrode substantially coaxially aligned between the first and second end caps. The ring electrode may include an opening extending along a radial direction of the ring electrode, wherein the radial direction is substantially perpendicular to the ejection axis.

Some disclosed embodiments may involve methods for performing mass analysis. One such method may comprise ionizing a sample in an ion trap through an opening separating at least part of first and second ring sections of the ion trap, wherein the first and second ring sections are configured to be substantially coaxially aligned along an ejection axis; and detecting ions ejected though an aperture on an end cap of the ion trap.

Another such method may comprise ionizing a sample in an ion trap through an opening of a ring electrode, the opening extending along a radial direction of the ring electrode, wherein the radial direction is substantially perpendicular to an ejection axis of the ion trap; and detecting ions ejected though an aperture on an end cap of the ion trap.

Another such method may comprise receiving ions of a sample into an ion trap through an opening separating at least part of first and second ring sections of the ion trap, wherein the first and second ring sections are configured to be substantially coaxially aligned along an ejection axis; and detecting ions ejected though an aperture on an end cap of the ion trap.

Another such method may comprise receiving ions of a sample into an ion trap through an opening of a ring electrode, the opening extending along a radial direction of the ring electrode, wherein the radial direction is substantially perpendicular to an ejection axis of the ion trap; and detecting ions ejected though an aperture on an end cap of the ion trap.

The preceding summary is not intended to restrict in any way the scope of the claimed invention. In addition, it is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate various embodiments and exemplary aspects of the present invention and, together with the description, explain principles of the invention. In the drawings.

DETAILED DESCRIPTION OF THE EMBODIMENTS

Figure 1A:
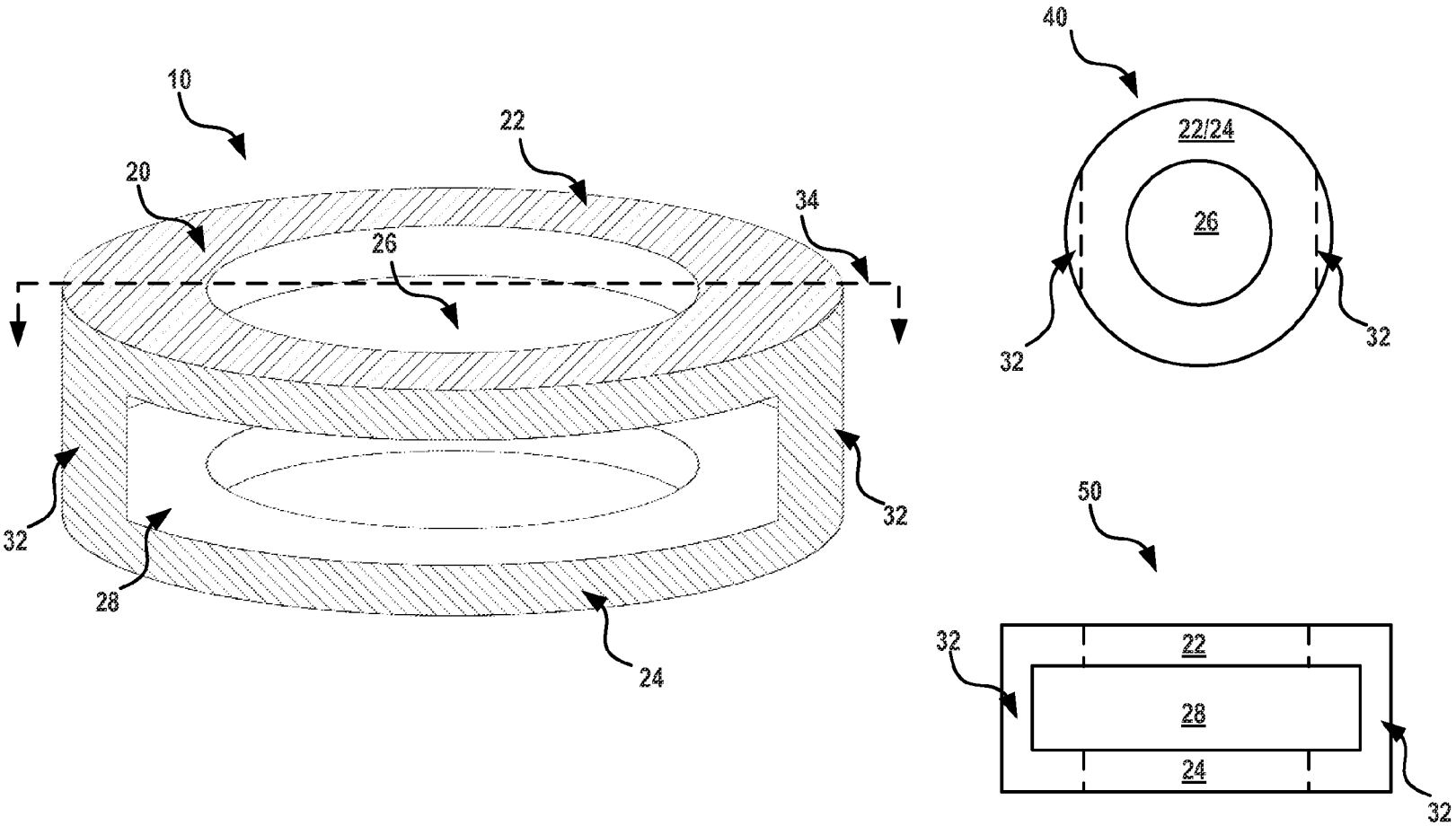
FIG. 1A is a schematic diagram of an exemplary ion trap component, in accordance with some disclosed embodiments.

Reference will now be made in detail to exemplary embodiments of the invention, examples of which are illustrated in the accompanying drawings. When appropriate, the same reference numbers are used throughout the drawings to refer to the same or like parts.

Embodiments of the present disclosure may involve apparatuses, systems, and methods for performing mass analysis. As used herein, mass analysis refers to techniques of analyzing masses of molecules or particles of a sample material. Mass analysis may include mass spectrometry, in which a spectrum of the masses and their relative abundance of the molecules or particles are generated and/or displayed. Mass analysis can be used to determine the chemical composition of a sample, the masses of molecules/particles, and/or to elucidate the chemical structures of molecules. Mass analysis can be conducted by using a mass spectrometer. A mass spectrometer may generally comprise three main parts: (1) an ionizer to convert some portion of the sample into ions based on electron ionization, photoionization, thermal ionization, chemical ionization, desorption ionization, electro or nano spray ionization, and/or other suitable processes; (2) an ion trap that sorts the sample ions by mass (or more particularly, by mass-to-charge (m/z) ratio); and (3) a detector that measures the quantity of ions sorted and expelled by the ion trap.

Ion trap mass spectrometers take several forms. For example, ion traps may include 3D quadrupole ion traps, linear ion traps, and cylindrical ion traps, among others.

A 3D quadrupole ion trap (QIT) typically comprises a central, donut-shaped hyberboloid ring electrode and two hyperbolic end cap electrodes. In the most basic usage, the end caps are held at a static potential, and the RF oscillating drive voltage is applied to the ring electrode. Ion trapping occurs due to the formation of a three dimensional quadrupolar trapping potential well in the central intra-electrode region when appropriate time-dependent voltages are applied to the electrodes. The ions oscillating in the trap become unstable in the Z-direction of the well and are ejected from the trap in order of ascending m/z ratio as the RF voltage or frequency applied to the ring is ramped. The ejected ions can be detected by an external detector, for example an electron multiplier, after passing through an aperture in one of the end cap electrodes.

A linear ion trap (LIT) also traps ions in a quadrupolar field, but whereas a 3D trap is radially symmetric about the Z axis, a LIT incorporates a two dimensional quadrupolar field that extends lengthwise. An advantage of an LIT is its larger trapping volume. LIT electrodes may also be substantially hyperbolic or substantially rectangular, where the latter is referred to as a rectilinear ion trap.

A cylindrical ion trap (CIT) refers to an ion trap comprising planar end cap electrodes and a cylindrical ring electrode instead of hyperbolic electrode surfaces. A CIT can produce a field that is approximately quadrupolar near the center of the trap, thereby providing performance comparable to quadrupole ion traps having a donut-shaped hyberboloid ring electrode. CITs may be favored for building miniature ion traps and/or mass analysis devices because CITs are mechanically simple and can be more easily manufactured.

The techniques disclosed in this application can be applied, for example, to CITs, where the electrode(s) between the two end caps are substantially cylindrical. As used herein, such ring-shaped electrodes can also be referred to as center electrodes, as they are between the two end caps. However, the word center does not necessarily mean that these electrodes are in the exact center of the ion trap.

FIG. 1A illustrates an exemplary ion trap component. In FIG. 1A, ion trap component 10 may include a ring electrode 20. In some embodiments, ring electrode 20 may be made from a single piece of material. As shown in FIG. 1A, ring electrode 20 may include an axial opening 26 (e.g., the vertical opening 26 shown in FIG. 1A). Ring electrode 20 may also include a radial opening 28 (e.g., the horizontal opening 28 shown in FIG. 1A). Radial opening 28 may be enclosed by an upper ring section 22, a lower ring section 24, and two vertical portions 32 that connect the upper and lower ring sections 22 and 24 (hereinafter "connecting portion 32" for simplicity). As used herein, an axial opening refers to an opening extending along a direction substantially parallel to the axis of ring electrode 20, while a radial opening refers to an opening extending along a direction substantially perpendicular to the axis of ring electrode 20. As used herein, an opening is considered to extend along a direction substantially perpendicular to the axis of a ring structure if the opening is on the side or side wall of the ring structure, such as ring electrode 20.

In some embodiments, ion trap component 10 may be formed by cutting out radial opening 28 from a single ring-shaped structure using techniques such as electric discharge machining, leaving the uncut portions between upper and lower ring sections 22 and 24 as connecting portions 32. In these embodiments, connecting portions 32 and ring sections 22 and 24 may be parts of a single body. Ions may be trapped inside ion trap component 10, for example, in the space defined by connecting portions 32 and ring sections 22 and 24. In some embodiments, ion trap component 10 may include only one connecting portion 32. For example, opening 28 may extend all the way towards the left or right side of ion trap component 10. In some embodiments, connecting portions 32 may be significantly distant from the inner boundary of axial opening 26 of ring electrode 20 so as not to distort the internal electric field generated by the ring electrode.

In FIG. 1A, view 40 is a top view of ion trap component 10, in which the dashed lines indicate the boundary of connecting portions 32 that are not visible from the top view. Similarly, view 50 is a side view of ion trap component 10, in which the dashed lines indicate the axial opening of ring electrode 20. It is noted that the inner diameters or thicknesses of upper and lower ring sections 22 and 24 may be different and the thickness of connecting portions 32 at different places may also be different. In some embodiment, ion trap component 10 may be used in an ion trap device for mass analysis.

Figure 1B:
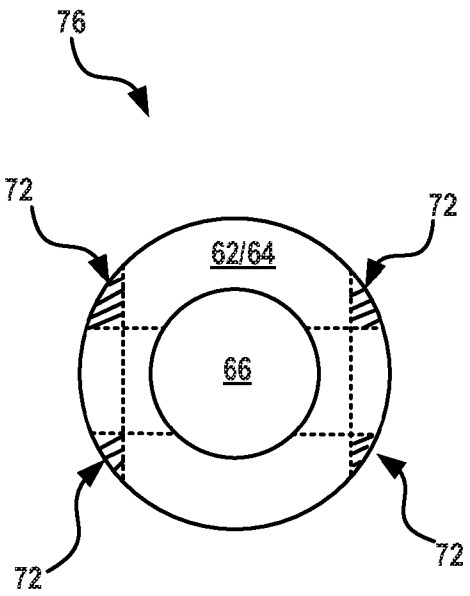
FIG. 1B is a schematic diagram of another exemplary ion trap component, in accordance with some disclosed embodiments.
Figure 1B:
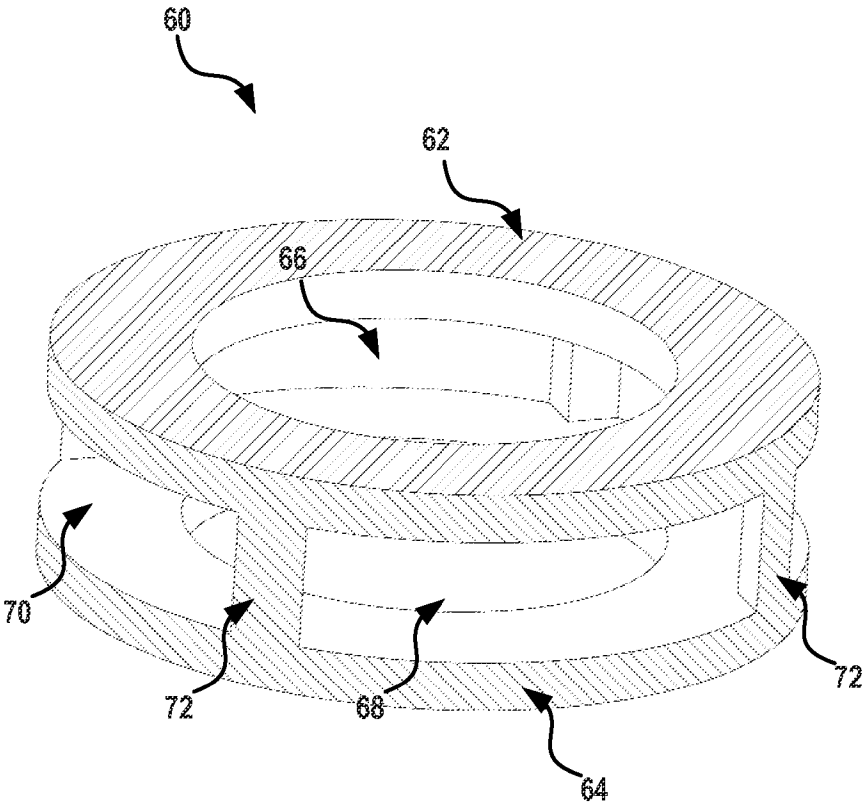

FIG. 1B illustrates another exemplary ion trap component 60. The difference between ion trap component 60 and ion trap component 10 shown in FIG. 1A is that ion trap component 60 includes two radial openings 68 and 70, each extending through the side of ion trap component 60. Similar to ion trap component 10, ion trap component 60 includes an upper section 62, a lower section 64, and four connecting portions 72. View 76 is a top view of ion trap component 60, in which the dashed lines indicate radial openings 68 and 70 that are not visible from the top view. The shadowed portions indicate four connecting portions 72. In some embodiments, radial openings 68 and 70 may be of the same size and perpendicular to each other. In some embodiments, the four connecting portions 72 may be symmetrical with respect to the center of ion trap component 60. In other embodiment, radial openings 68 and 70 may be of different sizes, and/or non-perpendicular to each other. The resulting connecting portions 72 may be asymmetrical with respect to the center of ion trap component 60.

Figure 1C:
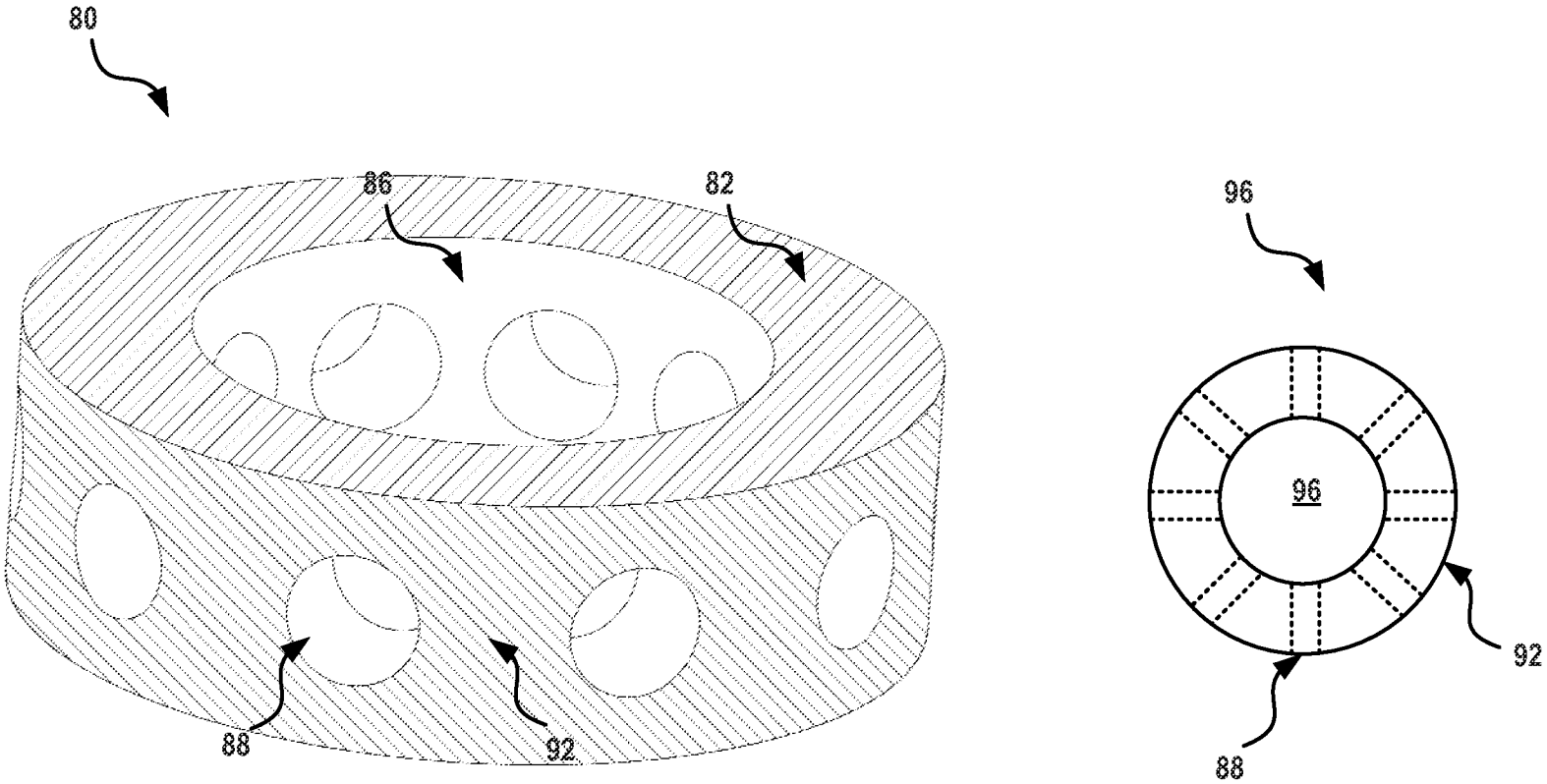
FIG. 1C is a schematic diagram of yet another exemplary ion trap component, in accordance with some disclosed embodiments.

FIG. 1C illustrate yet another exemplary ion trap component 80. As shown in FIG. 1C, ion trap component 80 may include a ring structure 82. Similar to the embodiments shown in FIGS. 1A and 1B, ring structure 82 includes an axial opening 86. However, ring structure 82 shown in FIG. 1C includes a number of radial openings 88. Radial openings 88 may be results of making through holes on the side of ring structure 82. For example, view 96 shows the top view of ion trap component 80, in which dashed lines indicate radial openings 88. In the embodiment shown in FIG. 1C, the portion between two adjacent radial openings may be considered as a connecting portion 92. It is noted that radial openings 88 may be of other shapes such as rectangular, triangular, etc., in addition to or instead of the circular shape shown in FIG. 1C.

Figure 1D:
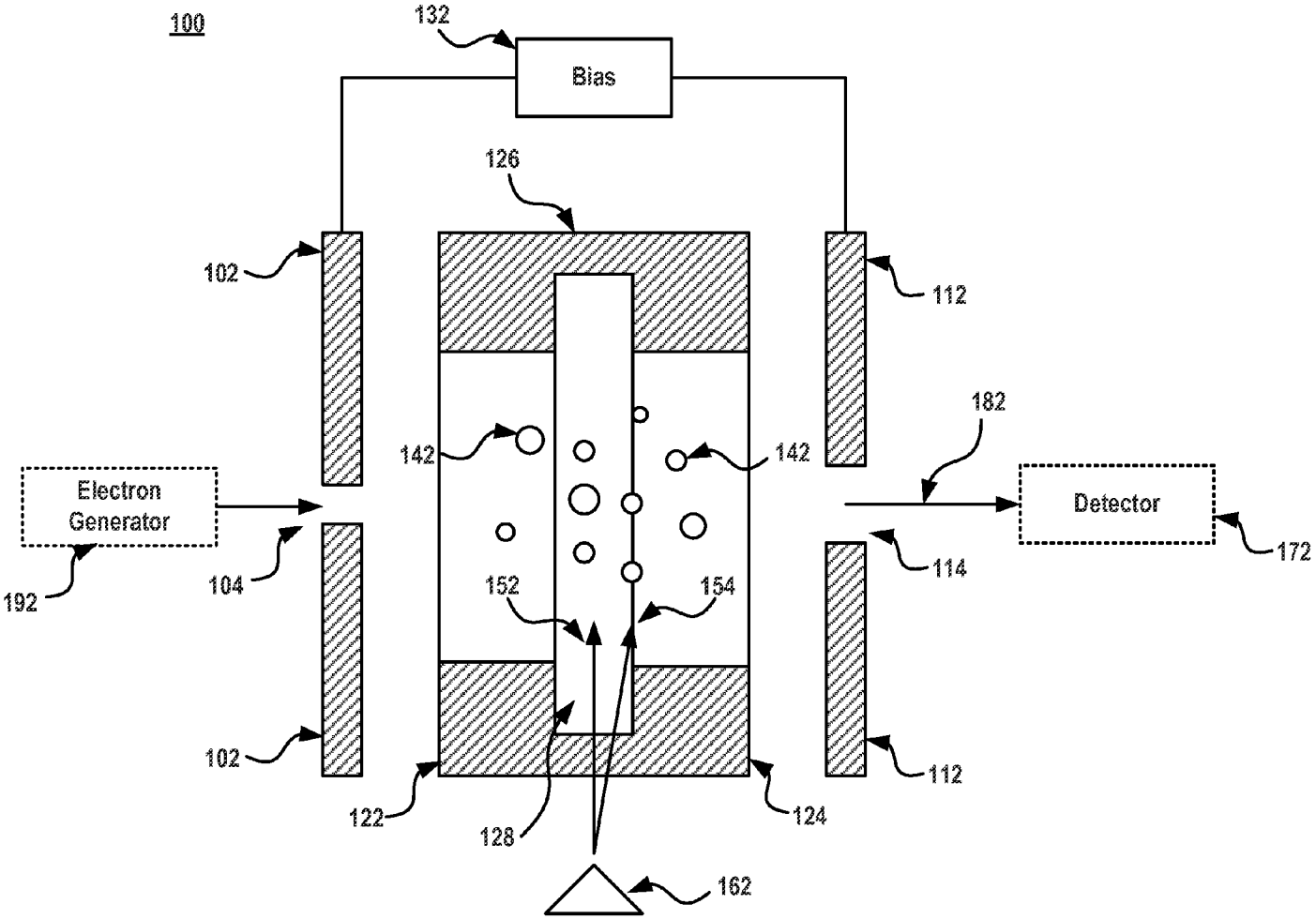
FIG. 1D is a schematic diagram of an exemplary mass analysis apparatus, in accordance with some disclosed embodiments.

FIG. 1D illustrates an exemplary apparatus for mass analysis. In FIG. 1D, apparatus 100 includes an ion trap. The ion trap may include one or more end caps. For example, in the embodiment shown in FIG. 1D, apparatus 100 includes two end caps 102 and 112. End cap 102 may include an aperture 104. End cap 112 may include an aperture 114. Apertures 104 and 114 may allow ions to enter and/or exit the ion trap. For example, ions can be injected into the ion trap through one of the apertures 104 and 114, and can be ejected or expelled from the ion trap through another one of the apertures 104 and 114. In some embodiments, one or more end caps may not have an aperture. For example, aperture 104 may not be present on end cap 102 when ions can be injected into the ion trap through other openings. In the embodiments shown in FIG. 1D, the size of apertures 104 and 114 are different. Such an asymmetrical configuration may create a hexapolar electrical field component in the ion trap. In other embodiments, however, the size of apertures 104 and 114 may be substantially the same.

End caps 104 and 114 may comprise doped silicon, stainless steel, aluminum, copper, nickel plated silicon or other nickel plated materials, gold, and/or other electrically conductive materials, and may be formed by laser etching, LIGA, dry reactive ion etching (DRIE) and other types of etching, micromachining, and/or other manufacturing processes.

Apparatus 100 may include one or more ring electrodes. For example, in the embodiment depicted in FIG. 1D, apparatus 100 includes a ring electrode having ring sections 122 and 124. It is noted that the cross-sectional view shown in FIG. 1D may correspond to the cross section along plane 34 in FIG. 1A and ring sections 122 and 124 may correspond to ring sections 22 and 24 in FIG. 1A. Similarly, embodiments shown in FIGS. 1B and 1C, or variations thereof, may also be used in apparatus 100 shown in FIG. 1D. Ring sections 122 and 124 may be substantially coaxial aligned. Each ring section may have a substantially cylindrical annulus shape. Each ring section may have an internal diameter that may be sized according to the particular application. For example, in one example embodiment, each ring section 122,124 has an internal diameter of about 4 mm. Smaller or larger diameters may also be used, however. Further, each ring section may have a thickness, the selection of which may again vary dependent upon the application. For example, in one example embodiment, each ring section 122,124 has a thickness of about 0.5 mm. Smaller or larger thicknesses may also be used, however. The internal diameter and thickness of ring sections 122 and 124 are not necessarily the same.

In some embodiments, ring sections 122 and 124 may be formed from a single ring structure. For example, ring sections 122 and 124 may be formed by at least partially splitting the single ring structure. In another example, ring sections 122 and 124 may be formed by creating a gap extending at least partially around the side of a single ring structure. The two ring sections 122 and 124 are not necessarily separate from each other. For example, they may connect to each other at least partially at one or more locations, such as at electrical connection 126 (e.g., connecting portion 32 in FIG. 1A). Ring sections 122 and 124 may be substantially similar in composition and/or manufacture relative to end caps 102 and 112.

Ring sections 122 and 124 may be electrically connected to each other by, for example, electrical connection 126. Electrical connection 126 may include a conductor physically connecting the two ring sections, or by means of continuous physical extension from one ring to the other (e.g., when the two rings are manufactured by splitting or creating a gap on a single ring structure, a partial splitting or a partial gap means that the two rings are still unseparated at some part). Electrical connection 126 makes ring sections 122 and 124 substantially equal electric potential.

Ring sections 122 and 124 may be substantially coaxial aligned along an ejection axis. For example, the coaxes of ring sections 122 and 124 may coincide with the axis of aperture 114, through which ions can be ejected from apparatus 100. The ejection axis may be defined as an axis along which ions exit the ion trap, sometimes referred to as Z axis. For example, in FIG. 1D, axis 182 indicates an ejection axis. After ions are ejected from apparatus 100, a detector 172 may be used to detect the quantity of ejected ions.

Ring sections 122 and 124 may be separated by an opening 128, through which ions or light can enter into the ion trap. Opening 128 may include the physical void by virtue of the split ring sections 122 and 124. In some embodiments, opening 128 may include a pass way formed by materials disposed between ring sections 122 and 124. For example, opening 128 may be surrounded by isolating materials deposited on the opposite surfaces of ring sections 122 and 128. Opening 128 may also include a particle guide extending through the rings. Ions 142 may enter into apparatus 100 via opening 128.

Ring section 122 may have a different internal diameter than ring section 124. Ring section 122 may have a different thickness than ring section 124, thus causing opening 128 not to be equally spaced from end caps 102 and 112. These differences between ring sections 122 and 124 may introduce a hexapole field component to the ion trap. In other embodiments, the thicknesses and inner diameters of ring sections 122 and 124 may be the same.

Ring sections 122, 124, and end caps 102, 112 when employed, collectively define an internal volume of the apparatus 100. The internal volume may include one or more potential wells that can trap ions 142.

In some embodiments, apparatus 100 may include an injector or a source 162 to inject or provide ions in the ion trap through opening 128. For simplicity, device 162 is referred to herein as an injector but may also function as a source. Injector 162 may include a flow injector (e.g., ions are injected by means of physical flow of particles), electrical injector (e.g., ions are injected by means of electrical force), magnetic injector (e.g., ions are injected by means of magnetic force), or the combination thereof. In some embodiments, injector 162 may be included as part of apparatus 100. In other embodiments, injector 162 may be an external component with respect to apparatus 100 but can work together with apparatus 100.

Figure 1E:
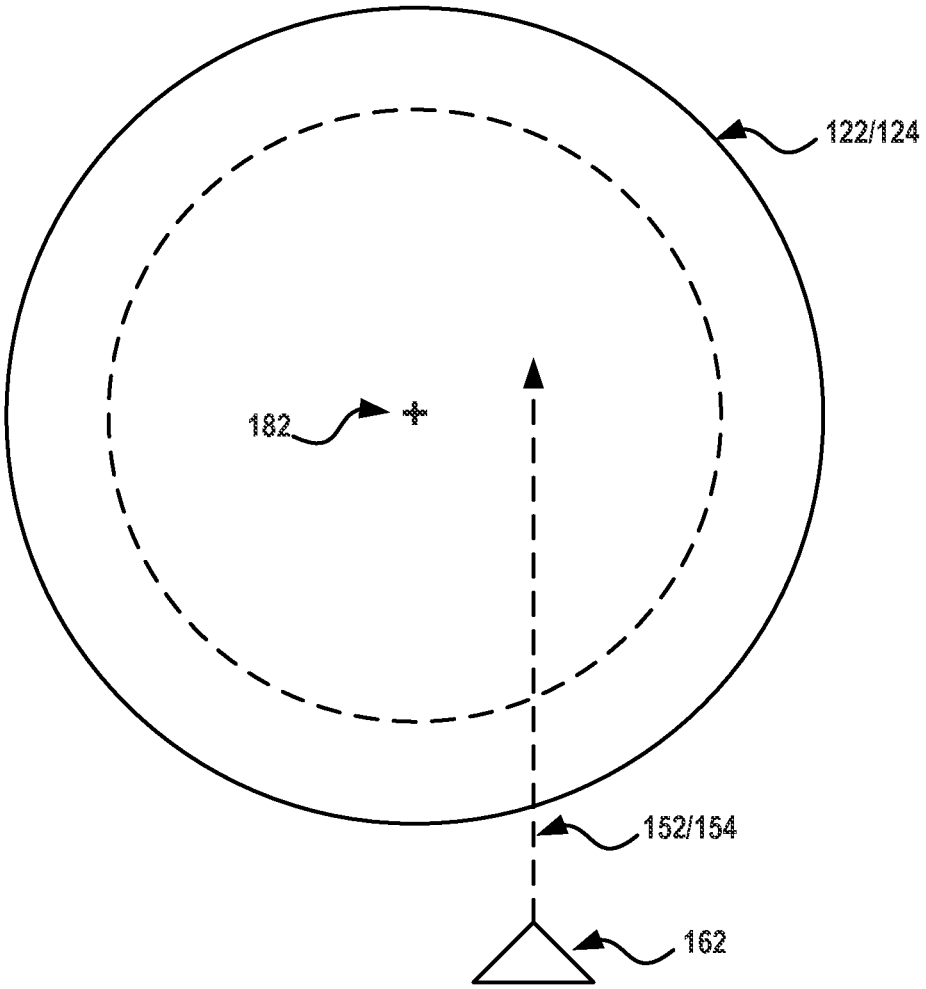
FIG. 1E is a schematic diagram of another exemplary mass analysis apparatus, in accordance with some disclosed embodiments.

In some embodiments, injector 162 may be configured to inject ions along a direction substantially perpendicular to the ejection axis 182. For example, ions may be injected into the ion trap along a trajectory 152. It is noted that trajectory 152 may include directions that are titled into or out of the page (e.g., trajectory 152 and ejection axis 182 may not be in the same plane but still substantially perpendicular to each other). In some embodiments, injector 162 may be configured to inject ions along a direction substantially non-perpendicular to the ejection axis 182. For example, ions may be injected into the ion trap along a trajectory 154. It is noted that trajectory 154 is not limited to left or right direction, but generally refers to any direction that is not perpendicular to the ejection axis 182 (e.g., trajectory 154 and ejection axis 182 may not be in the same plane). In some embodiments, injector 162 may be configured to inject ions along a trajectory or direction displaced from the ejection axis 182. For example, as shown in FIG. 1E, ions may also be injected along an axis away from the ejection axis 182 of the electrode sections 122 and 124. The trajectory of the injected ions may also be a combination of one or more of these locations and directions. By injecting ions through opening 128 instead of aperture 104, the capture efficiency may be improved.

In some embodiments, injector 162 may function as an ionization source. In such embodiments, injector 162 can be referred to as ionizer 162. Instead of injecting ions into apparatus 100, ionizer 162 may provide energy into the ion trap through opening 128 to ionize samples to ions within the ion trap. For example, ionizer 162 may include a UV lamp for photoionization, an electron ionization source, or other suitable ionization sources. By providing ionization energy through opening 128 on the side of the ring electrode, ion capture efficiency may be improved compared to providing energy through apertures on the end caps, at least because (1) opening 128 may be bigger than any apertures and (2) ions formed in a disk like region can be more easily captured than ions formed from an axially positioned ionization source. Similar to injecting ions into the ion trap, ionization energy may be applied substantially perpendicular to the ejection axis, substantially non-perpendicular to the ejection axis, or along a trajectory or direction displaced from the ejection axis (e.g., as shown in FIG. 1E).

In some embodiments, apparatus 100 may comprise an electron generator 192. Electron generator 192 may act as an ionizer (e.g., instead of or in addition to injector/ionizer 162) to generate electrons that enter into the ion trap through, for example, aperture 104. The electrons may be used to ionize neutral molecules inside the ion trap.

In some embodiments, apparatus 100 may comprise a biasing device 132 to electrically bias end cap 102, 112, or both. Bias device 132 may include active devices such as a voltage source, a signal generator, etc, to provide DC and/or AC bias signals. In some embodiments, bias device 132 may include passive devices such as a capacitor, a resistor, etc., to provide bias signals to end cap 102 and/or 112 through coupling with the signals applied to ring sections 122, 124. The bias signal generated by bias device 132 creates electrical field across the internal volume of apparatus 100, which may apply electrical force to ions 142 so that their trajectory may be changed in response to the bias signal.

For example, the bias signal may effectively change the trajectory of ions from 152 to 154. Without the bias signal, a positively charged ion can be injected into apparatus 100 along the direction indicated by 152. The ion may substantially keep that direction until the trapping electrical field starts to capture the ion. With the bias signal (e.g., assuming the direction of electrical field is from left to right, i.e., end cap 102 has a high potential than end cap 112), however, the ion will depart from trajectory 152 right after entering into apparatus 100 and start to fly towards the right (for a positively charged ion) or left (for a negatively charged ion), due to the electrical force applied to the ion. As a result, even if the ion is initially injected into the ion trap along a direction substantially perpendicular to the Z axis, the actual trajectory will become a non-perpendicular one due to the bias signal.

Figure 2A:
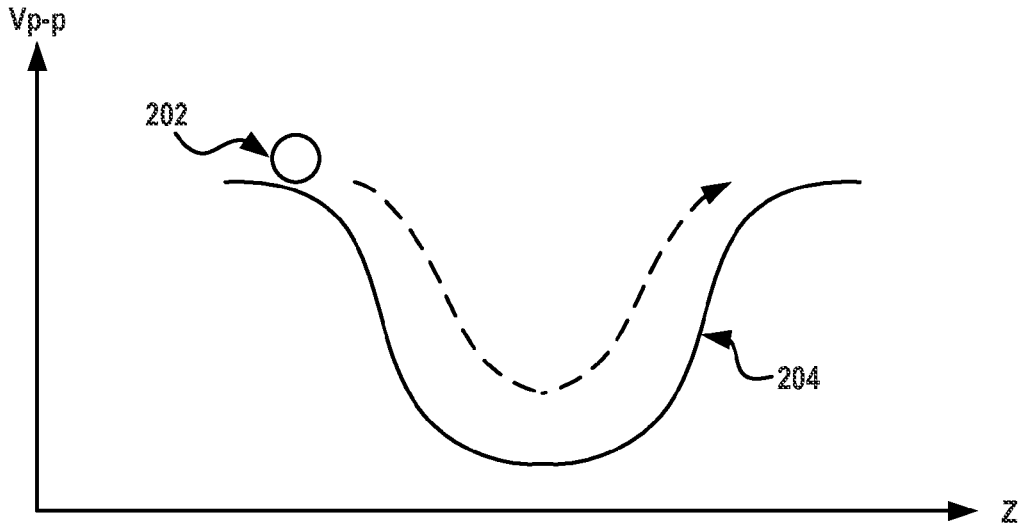
FIGS. 2A and 2B are diagrams illustrating physical principles utilized by some exemplary mass analysis systems, in accordance with some disclosed embodiments.
Figure 2B:
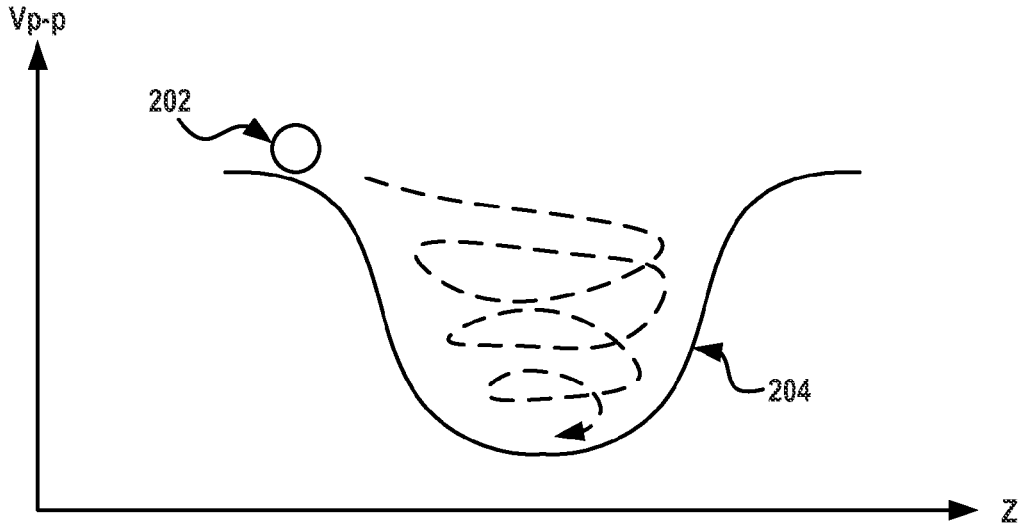

FIGS. 2A and 2B illustrate exemplary effects of injecting ions in different manners. In FIG. 2A, an ion 202 is injected into a potential well 204 in the center region of an ion trap. The horizontal axis indicates a direction along Z axis (e.g., ejection axis 182), and the vertical axis indicates the potential level (e.g., Vp-p). The reversed bell shape of potential well 204 indicates that the electrical potential is higher in the outer regions and gradually reduced to the lowest level in the center region. When ion 202 enters into potential well 204 along the direction substantially coinciding with the electrical field direction (i.e., a direction along which the potential drops the quickest), the speed increase of ion 202 will also be the fastest (e.g., due to the conversion of potential energy to kinetic energy). Therefore, ion 202 may more likely escape from the potential well 204 without being captured. FIG. 2B shows another situation in which ion 202 is injected along a different direction from the electrical field direction. In this case, the direction of the ion is continuously being redirected by the potential and may less likely to escape from potential well 204 as its energy is split between the radial and axial direction vectors. Therefore, an ion trap may capture more ions if the ions are injected in the manner illustrated in FIG. 2B than in FIG. 2A.

Return to FIG. 1D, if ions are to be injected through aperture 104, then the ions may more likely to escape from apparatus 100, similar to the simplified situation shown in FIG. 2A. If ions are to be injected through opening 128 along direction 154, or along direction 152 with bias signals applied, then the ions may more likely to be captured by apparatus 100.

Figure 3:
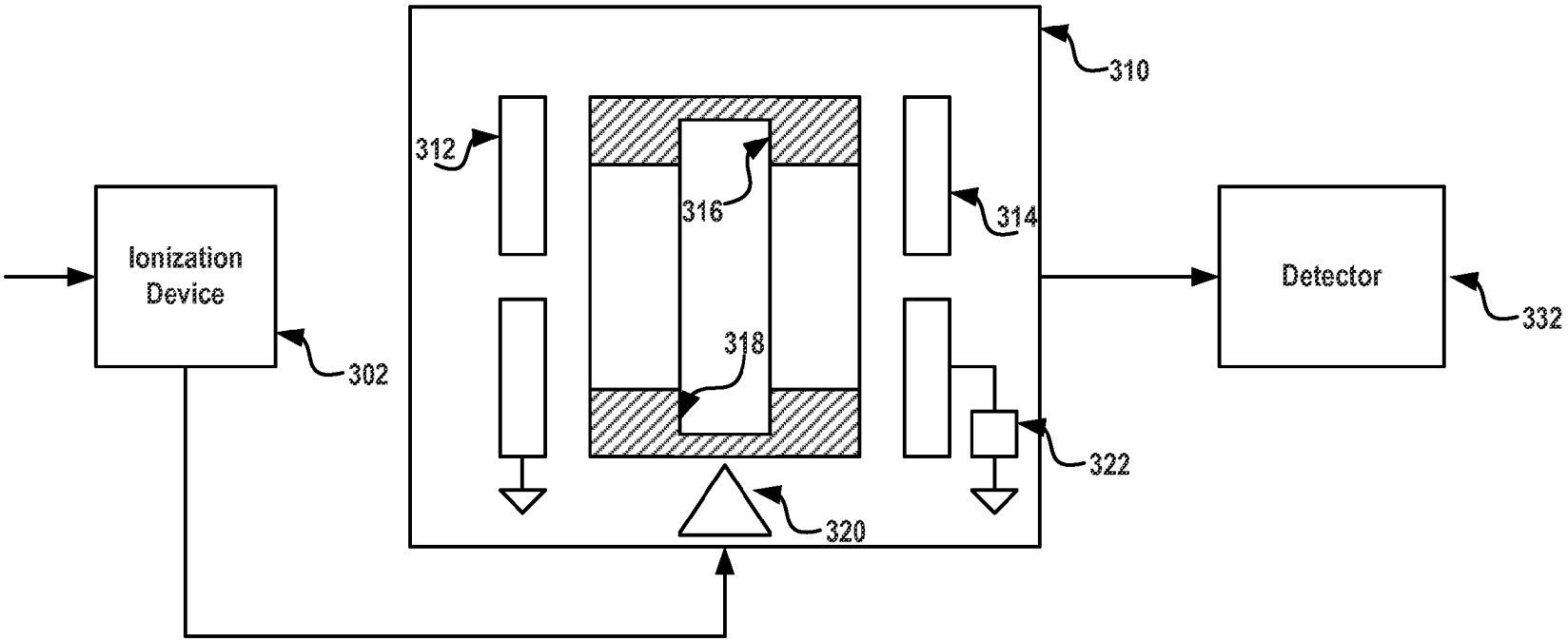
FIG. 3 illustrates a schematic diagram of an exemplary mass analysis system, in accordance with some disclosed embodiments.

FIG. 3 illustrates a schematic diagram of an exemplary mass analysis system, in accordance with some disclosed embodiments. The mass analysis system may include an ion trap apparatus 310, an ionization device 302, and a detector 332. Ion trap apparatus 310 may be similar to apparatus 100. For example, ion trap apparatus 310 may include end caps 312 and 314, ring sections 316 and 318, injector 320 (e.g., similar to injector 162), and bias device 322. Ionization device 302 may be operable to convert some portion of a sample into ions based on electron ionization, photoionization, thermal ionization, chemical ionization, desorption ionization, electro or nano spray ionization, and/or other suitable processes. Injector 320 may include a single device or multiple injection devices. In some embodiments, multiple injection devices may be accommodated based on, for example, multiple radial openings to inject ions into the ion trap.

Detector 332 may include a single-point ion collector, such as a Faraday cup or electronic multiplier. In some embodiments, detector 332 may alternatively or additionally include a multipoint collector, such as an array or microchannel plate collector. Other suitable detectors may also be used.

Figure 4:
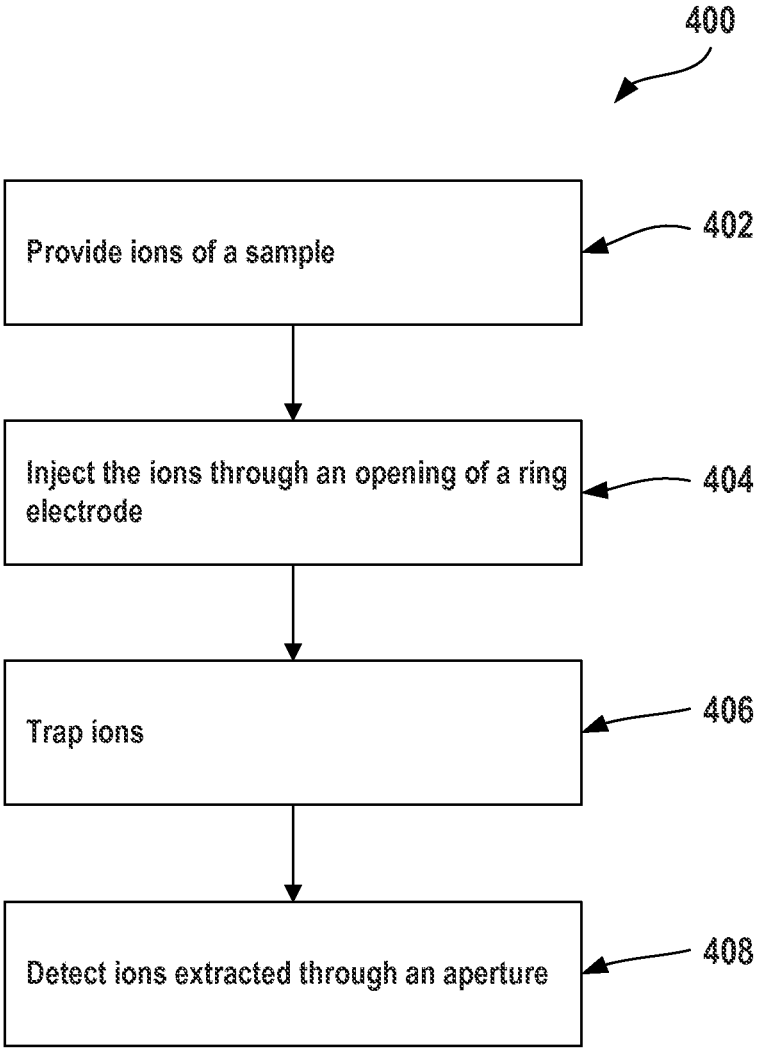
FIG. 4 is a flow chart of an exemplary method for performing mass analysis, in accordance with some disclosed embodiments.

FIG. 4 is a flow chart of an exemplary method for performing mass analysis, in accordance with some disclosed embodiments. In FIG. 4, a mass analysis method 400 includes a series of steps, some of them may be optional. In step 402, ions of a sample to be analyzed may be provided, such as by an ionization device (e.g., 302 in FIG. 3). In step 404, ions may be injected through an opening (e.g., opening 28 in FIG. 1A) extending radially along a ring electrode (e.g., ring electrode 20 in FIG. 1A) by an injector (e.g., injector 162 in FIG. 1D). In some embodiments, ions may be generated inside the ion trap by an ionization process due to energy entering through the opening (e.g., by ionizer 162 in FIG. 1D). The ions may be injected substantially perpendicular to the ejection axis (e.g., Z axis) with a bias signal applied or substantially non-perpendicular to the ejection axis. In step 406, ions are trapped in the applied electric field. In step 408, ions ejected through an aperture (e.g., aperture 114 in FIG. 1D) may be detected by a detector (e.g., detector 172 in FIG. 1D).

In the foregoing description of exemplary embodiments, various features are grouped together in a single embodiment for purposes of streamlining the disclosure. This method of disclosure is not to be interpreted as reflecting an intention that the claims require more features than are expressly recited in each claim. Rather, as the following claims reflect, inventive aspects lie in less than all features of a single foregoing disclosed embodiment. Thus, the following claims are hereby incorporated into this description of the exemplary embodiments, with each claim standing on its own as a separate embodiment of the invention.

Moreover, it will be apparent to those skilled in the art from consideration of the specification and practice of the present disclosure that various modifications and variations can be made to the disclosed systems and methods without departing from the scope of the disclosure, as claimed. Thus, it is intended that the specification and examples be considered as exemplary only, with a true scope of the present disclosure being indicated by the following claims and their equivalents.

What is claimed is:

1. An ion trap device, comprising:

a first end cap having a first aperture;

a second end cap having a second aperture, wherein the first aperture and the second aperture define an ejection axis; and a ring electrode substantially coaxially aligned between the first and second end caps, wherein the ring electrode includes:

first and second ring sections oriented in first and second parallel planes that are substantially perpendicular to the ejection axis, wherein the first and second ring sections are electrically connected to each other through a connecting portion and the first and second ring sections each has a substantially cylindrical annulus shape; and a radial opening enclosed at least in part by the connecting portion, wherein the radial opening extends along a radial direction of the ring electrode, the radial direction being substantially perpendicular to the ejection axis, and wherein a width of the radial opening is greater than an internal diameter of the ring electrode.

2. The ion trap device of claim 1, wherein the ion trap is configured to receive ions through the radial opening.

3. The ion trap device of claim 1, further comprising an injector to inject ions into the ion trap through the radial opening.

4. The ion trap device of claim 3, wherein the injector is configured to inject ions along the radial direction.

5. The ion trap device of claim 3, wherein the injector is configured to inject ions along a direction substantially non-perpendicular to the ejection axis.

6. The ion trap device of claim 3, wherein the injector is configured to inject ions along a trajectory displaced from the ejection axis.

7. The ion trap device of claim 1, further comprising a biasing device to electrically bias at least one of the first or the second end cap.

8. The ion trap device of claim 1, wherein the first and second apertures have substantially a same size.

9. The ion trap device of claim 1, wherein the first and second apertures have different sizes.

10. The ion trap device of claim 1, further comprising an ionizer to perform ionization in the ion trap device through the radial opening.

11. The ion trap device of claim 10, further comprising a second ionizer to perform ionization in the ion trap device through the first aperture.

12. The ion trap device of claim 1, wherein the first and second ring sections have at least one of:

a same thickness; or a same internal diameter.

13. The ion trap device of claim 1, wherein the first and second ring sections have at least one of:

different thicknesses; or different internal diameters.

14. The ion trap device of claim 1, wherein the ion trap device is a cylindrical ion trap device.

15. A method for performing mass analysis, comprising:

ionizing a sample in an ion trap through a radial opening separating at least part of first and second ring sections of a ring electrode of the ion trap, wherein:

the first and second ring sections are configured to be substantially coaxially aligned along an ejection axis;

the first and second ring sections are oriented in first and second parallel planes that are substantially perpendicular to the ejection axis, wherein the first and second ring sections are electrically connected to each other through a connecting portion and the first and second ring sections each has a substantially cylindrical annulus shape; and the radial opening is enclosed at least in part by the connecting portion, wherein the radial opening extends along a radial direction of the ring electrode, the radial direction being substantially perpendicular to the ejection axis, and wherein a width of the radial opening is greater than an internal diameter of the ring electrode; and detecting ions ejected though an aperture on an end cap of the ion trap.

16. The method of claim 15, wherein ionizing the sample is through photoionization.

17. The method of claim 15, wherein ionizing the sample is through electron ionization.

18. The method of claim 15, wherein ionizing the sample is through applying energy along a direction substantially perpendicular to the ejection axis.

19. The method of claim 15, wherein ionizing the sample is through applying energy along a direction substantially non-perpendicular to the ejection axis.

20. The method of claim 15, further comprising applying electrical bias to the end cap.

21. A method for performing mass analysis, comprising:

ionizing a sample in an ion trap through a radial opening of a ring electrode, wherein:

the ring electrode includes first and second ring sections oriented in first and second parallel planes that are substantially perpendicular to an ejection axis of the ion trap, wherein the first and second ring sections are electrically connected to each other through a connecting portion and the first and second ring sections each has a substantially cylindrical annulus shape; and the radial opening is enclosed at least in part by the connecting portion, wherein the radial opening extends along a radial direction of the ring electrode, the radial direction being substantially perpendicular to the ejection axis of the ion trap, and wherein a width of the radial opening is greater than an internal diameter of the ring electrode; and detecting ions ejected though an aperture on an end cap of the ion trap.

22. A method for performing mass analysis, comprising:

receiving ions of a sample into an ion trap through a radial opening separating at least part of first and second ring sections of a ring electrode of the ion trap, wherein:

the first and second ring sections are configured to be substantially coaxially aligned along an ejection axis;

the first and second ring sections are oriented in first and second parallel planes that are substantially perpendicular to the ejection axis, wherein the first and second ring sections are electrically connected to each other through a connecting portion and the first and second ring sections each has a substantially cylindrical annulus shape; and the radial opening is enclosed at least in part by the connecting portion, wherein the radial opening extends along a radial direction of the ring electrode, the radial direction being substantially perpendicular to the ejection axis, and wherein a width of the radial opening is greater than an internal diameter of the ring electrode; and detecting ions ejected though an aperture on an end cap of the ion trap.

23. The method of claim 22, wherein receiving ions of the sample includes receiving ions injected into the ion trap by an injector through the radial opening.

24. A method for performing mass analysis, comprising:

receiving ions of a sample into an ion trap through a radial opening of a ring electrode, wherein:

the ring electrode includes first and second ring sections oriented in first and second parallel planes that are substantially perpendicular to an ejection axis of the ion trap, wherein the first and second ring sections are electrically connected to each other through a connecting portion and the first and second ring sections each has a substantially cylindrical annulus shape; and the radial opening is enclosed at least in part by the connecting portion, wherein the radial opening extends along a radial direction of the ring electrode, the radial direction being substantially perpendicular to the ejection axis of the ion trap, and wherein a width of the radial opening is greater than an internal diameter of the ring electrode; and detecting ions ejected though an aperture on an end cap of the ion trap.

25. The method of claim 22, wherein receiving ions of the sample includes receiving ions injected into the ion trap along the radial direction.

26. The method of claim 22, wherein receiving ions of the sample includes receiving ions injected into the ion trap along a direction substantially non-perpendicular to the ejection axis.

27. The method of claim 22, wherein receiving ions of the sample includes receiving ions injected into the ion trap along a trajectory displaced from the ejection axis.

* * * * *